US007635230B2

(12) United States Patent
Liao et al.

(10) Patent No.: US 7,635,230 B2
(45) Date of Patent: Dec. 22, 2009

(54) FRONT COVER STRUCTURE FOR A LABEL PRINTER

(75) Inventors: Hung-Kun Liao, Keelung (TW); Shang-Shih Kuo, Yonghe (TW)

(73) Assignee: TSC Auto ID Technology Co., Ltd., I-Lan Ishein (TW)

( * ) Notice: Subject to any disclaimer, the term of this patent is extended or adjusted under 35 U.S.C. 154(b) by 447 days.

(21) Appl. No.: 11/723,414

(22) Filed: Mar. 20, 2007

(65) Prior Publication Data

US 2008/0229942 A1 Sep. 25, 2008

(51) Int. Cl.
*B41J 15/00* (2006.01)

(52) U.S. Cl. ..... 400/613; 400/691; 400/693; 400/594; 400/512

(58) Field of Classification Search ..... 400/613, 400/693, 691, 594, 512, 88
See application file for complete search history.

(56) References Cited

U.S. PATENT DOCUMENTS 5,137,385 A * 8/1992 Kamimura et al. ..... 400/690.4
5,486,259 A * 1/1996 Goodwin et al. ..... 156/384
6,158,342 A * 12/2000 Moore ..... 101/407.1
7,011,463 B2 * 3/2006 Matsuse ..... 400/594
7,033,097 B2 * 4/2006 Petteruti et al. ..... 400/693
2005/0232679 A1 * 10/2005 Na et al. ..... 400/649
2006/0165467 A1 * 7/2006 Kawakami et al. ..... 400/613

* cited by examiner

*Primary Examiner*—Judy Nguyen
*Assistant Examiner*—Matthew G Marini
(74) *Attorney, Agent, or Firm*—Rosenberg, Klein & Lee

(57) ABSTRACT

A front cover structure is used in a label printer, including a back board forming a paper roll support device; a front board coupled to the back board and defining a first hole and including a first cross bar, a second cross bar and a third cross bar, of which the second and third cross bars are parallel to and positioned against the first cross bar; a pressing board defining two second holes in two side projections thereof and a third hole, and being coupled to the front board with a first connection bar extending through the first hole and the second holes; and a lock board defining a plurality of fourth holes in opposite edge portions and being coupled to the pressing board with a second connection bar extending through the third hole and the fourth holes.

9 Claims, 5 Drawing Sheets

FRONT COVER STRUCTURE FOR A LABEL PRINTER

BACKGROUND OF THE INVENTION

1. Field of the Invention

The present invention generally relates to a label printer, and in particular to the structure of a front cover of the label printer, which simplifies mounting and feeding of label paper in the printer.

2. The Related Arts

In a conventional label printer, a label paper feeding mechanism is arranged inside the label printer. Each time the label paper is to be replaced, the operation of replacing label paper is constrained by the internal structure of the label printer. For example, the label paper must be installed along a feeding path inside the printer. The trend of miniaturization of the label printer makes the internal space of the printer substantially reduced, which in turn leads to complication of the mechanics inside the printer. Thus, the internal paper feeding mechanism and the mounting of the label paper into the printer become troublesome to the general users.

In the trend of miniaturization of label printers, the arrangement of the label paper inside the printer and the design of the paper feeding paper inside the printer are important factors. With the internal space of the label printer substantially reduced, integration of parts and efficient use of the internal space of the printer in order to provide efficient means for installation of label paper is one of the most important challenges of the development of the label printers.

SUMMARY OF THE INVENTION

Thus, the present invention is aimed to solve the needs of the industry of label printer by providing a front cover structure for the label printers, which overcome the drawbacks discussed above in respect of the conventional label printers.

To realize the above object, in accordance with the present invention, a front cover structure is provided for label printers. The front cover comprises a back board forming a paper roll support device; a front board coupled to the back board and defining a first hole and comprising a first cross bar, a second cross bar and a third cross bar, of which the second and third cross bars are parallel to and positioned against the first cross bar; a pressing board defining two second holes in two side projections thereof and a third hole, and being coupled to the front board with a first connection bar extending through the first hole and the second holes; and a lock board defining a plurality of fourth holes in opposite edge portions and being coupled to the pressing board with a second connection bar extending through the third hole and the fourth holes.

BRIEF DESCRIPTION OF THE DRAWINGS

In order to clearly show and make better comprehension of these and other features and advantages of the present invention, the present invention will now be described by way of examples, with reference to a preferred embodiment illustrated in the drawings, in which.

DETAILED DESCRIPTION OF THE PREFERRED EMBODIMENT

The present invention is aimed to provide a front cover structure of a label printer. To clearly demonstrate the present invention, details regarding operation process and constituent parts of the present invention will be described in detail. However, it is apparent that the present invention is not limited to the specific details so described and known to those having ordinary skills of the art. Further, structure and operation of a label printer that are known to those having ordinary skills will not be included in the following description for simplicity and to avoid impose unnecessary constraints to the present invention. Although a detailed description of the present invention will be given as follows, the present invention can also be extensively employed in other applications whereby the scope of the present invention is defined solely by the claims that are given after the following description of a preferred embodiment of the present invention.

The present invention provides a front cover of a label printer wherein brackets for supporting label paper and feeding rollers (bars) are arranged on the front cover of the label printer, whereby opening the front cover from the printer separates the label paper mounting/dismounting system from the printer. This simplifies the mounting/dismounting operation of the label paper to eliminate the inconvenience of label paper roll in a compact-sized label printer. Such an integrated front cover structure also provides advantages in trouble shooting or adjustment for the label printer, such as paper jamming or adjustment of paper feeding.

Figure 1:
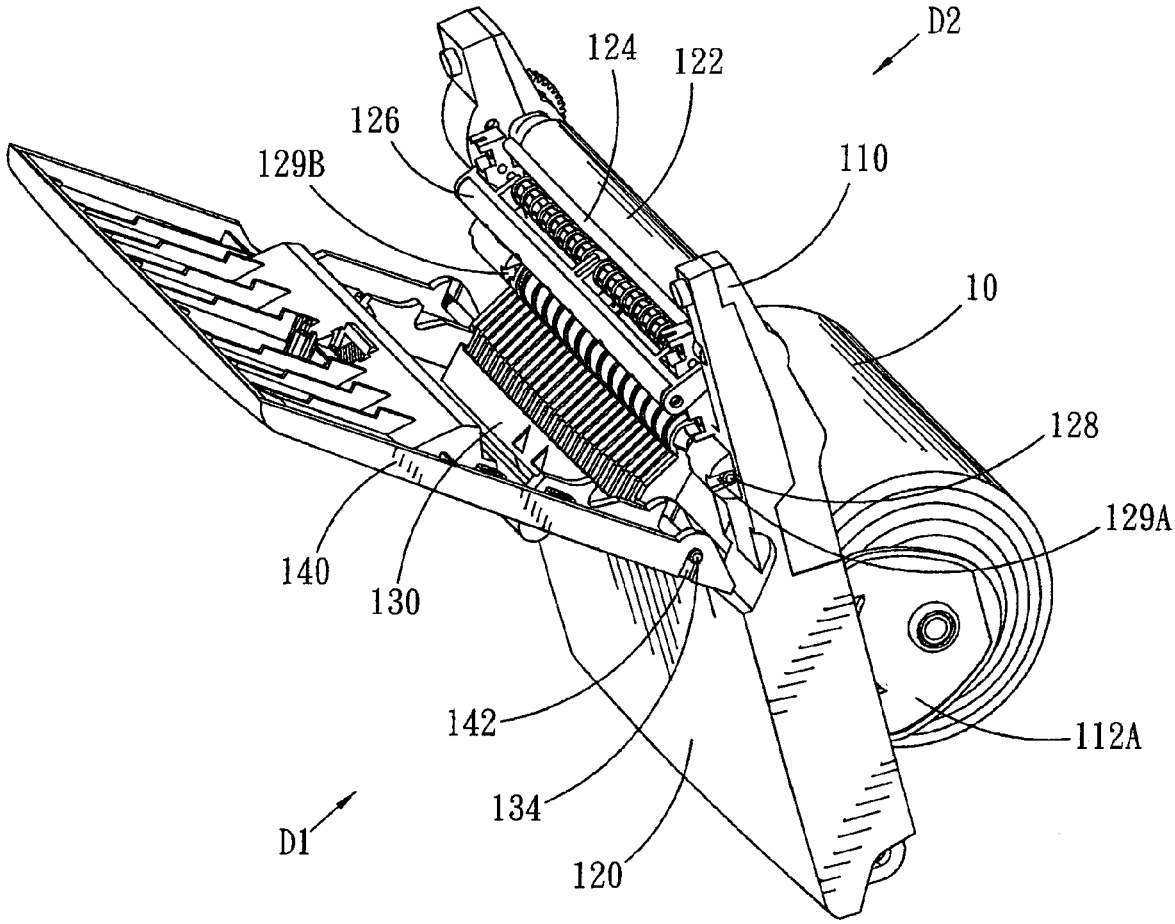
FIG. 1 shows a perspective view of a front cover structure of a label printer in accordance with the present invention.

With reference to the drawings and in particular to FIG. 1, which shows a preferred embodiment of a front cover for a label printer in accordance with the present invention, the front cover comprises a back board 110, a front board 120, a pressing board 130, and a lock board 140. The back board 110 has a first surface, to which a roll of label paper 10 is mounted, forming two paper roll brackets 112A, 112B (of which bracket 112B is not visible in the drawing) opposing each other, and a second surface, which is opposite to the roll of the label paper 10, coupled to the front board 120 by means of for example bolts or snap-on fasteners. The front board 120 comprises a first cross bar 122, a second cross bar 124, and a third cross bar 126, of which the relationship and the functions will be described hereinafter. The front board 120 defines at least one first hole for coupling the pressing board 130. In the embodiment illustrated, the front board comprises two first holes 129A, 129B respectively formed on opposite lateral edge portions of the front board 120, and a further first hole located between the first holes 129A, 129B. The front board 120 is coupled to the pressing board 130 with a first connection bar 128 extending in sequence through the first hole 129A, said further one first hole, and the first hole 129B whereby the pressing boar 130 is rotatable with the first connection board 128 as a rotation center. The lock board 140 forms a plurality of fourth holes 142 located on opposite lateral edge portions thereof for coupling the pressing board 130. In the embodiment illustrated, the lock board 140 is coupled to the pressing board 130 with a second connection bard 134 extending through the fourth holes 142 whereby the lock board 140 is rotatable with the second connection bar 134 as a rotation center. Connection between the front board 120 and the pressing board 130, and between the pressing board 130 and the lock board 140, will be further described hereinafter with reference to exploded views taken in first direction D1 and second direction D2.

Figure 2A:
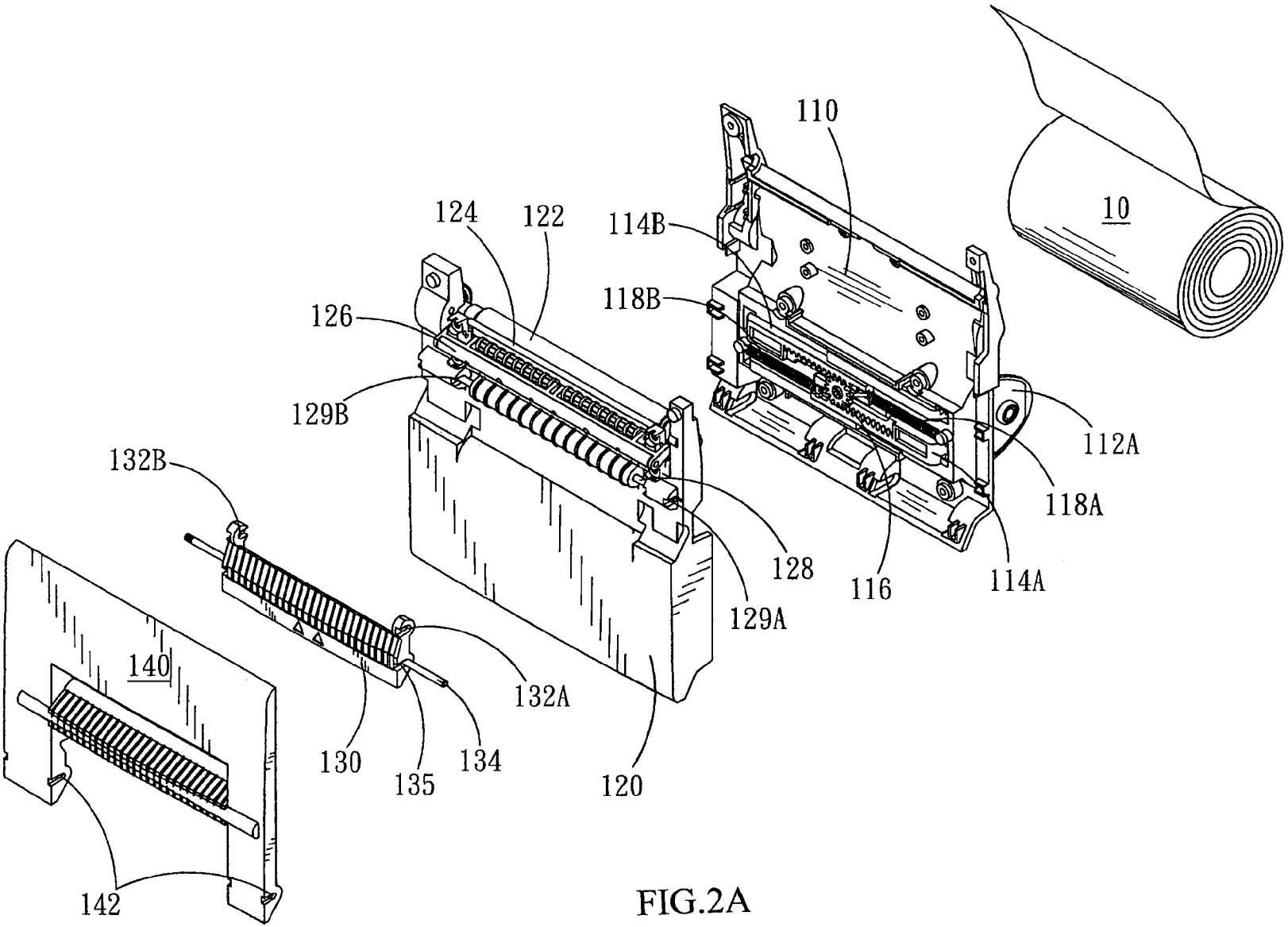
FIG. 2A is an exploded view of the front cover of the present invention taken in a first perspective.
Figure 2B:
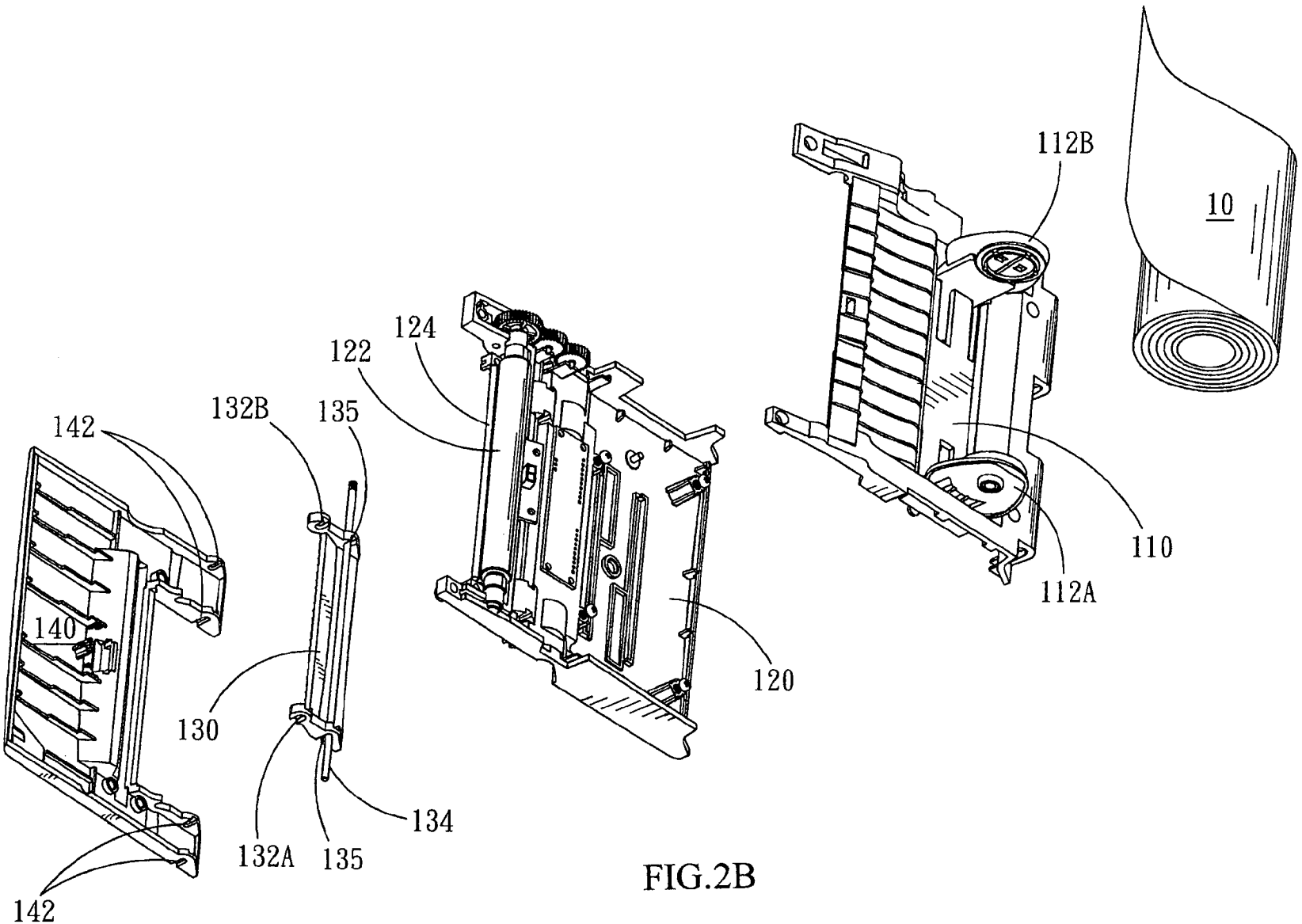
FIG. 2B is also an exploded view of the front cover of the present invention, but taken in a second perspective.

With reference to FIGS. 2A and 2B, which are exploded views taken in the first and second directions D1, D2, the back board 11, besides the two paper roll brackets 112A, 112B that are formed on the first surface thereof to which the paper roll 10 is mounted, also comprises two racks 14A, 114B, a pinion 116 and two resilient structures 118A, 118B. The racks 114A, 114B are coupled, through holes defined in the back board 110, to the paper roll brackets 112A, 112B arranged on the first surface of the back board 110, respectively and, in the embodiment illustrated, the coupling is preferably a perpendicular connection. The pinion 116 is arranged between the racks 114A, 114B and engages the racks 114A, 114B at upper and lower tangents thereof. The resilient structures 118A, 118B are fixed to the two racks 114A, 114B, respectively, and fixed points on opposite sides of the back board 110 so as to induce a center-directed biasing force. In the embodiment, the resilient structures 118A, 118B comprise springs. The paper roll brackets 112A, 112B, the racks 114A, 114B, the pinion 116, and the resilient structures 118A, 118B, are just illustrated as a preferred embodiment of a paper roller support device for the present invention.

The front board 120 comprises a first cross bar 122, a second cross bar 124, and a third cross bar 126, of which the second and third cross bars 124, 126 are parallel to and positioned against the first cross bar 122. The first cross bar 122 serves to press against a printer head (not shown) to force the label paper to engage the printer head in a printing operation. In the embodiment illustrated, the first cross bar 122 comprises a fixed shaft. The second cross bar 124 serves to release printed labels, namely to separate the label from a substrate of the label paper. In the embodiment, the second cross bar 124 may also be referred to as label release bar. The third cross bar 126 cooperates with the first cross bar 122 to discharge the substrate of the label paper of which the label is released to outside the printer. In the embodiment, the third cross bar 126 has a movable shaft, which will be further described with reference to FIGS. 3A and 3B.

As described above, the front board 120 has at least one first hole, such as the first hole 129A, 129B and the further first hole located therebetween for coupling with the pressing board 130. The pressing board 130 defines two second holes 132A, 132B, which are defined in opposite side projections of the pressing board 130. Thus, in the embodiment illustrated, the first connection bar 128 extends in sequence through the first hole 129A, the second hole 132A, the further first hole, the second hole 132B, and the first hole 129B to couple the pressing board 130 and the front board 120 together so that the pressing board 130 is allow to rotate with the first connection bar 128 as rotation center. As described above, the lock board 140 has a plurality of fourth holes 142 located on opposite side portions for coupling with pressing board 130. The pressing board 130 has one or two third holes 135. In the embodiment illustrated, the lock board 140 and the pressing board 130 are coupled together by having the second connection bar 134 extending through the fourth holes 142 and the third holes 135 whereby the lock board 140 is rotatable with the second connection bar 134 as the rotation center. In the embodiment illustrated, the lock board 140 comprises a U-shaped plate having two limbs connected by a bottom and the fourth holes 142 are defined in outer and inner side faces of the limbs.

Figure 3A:
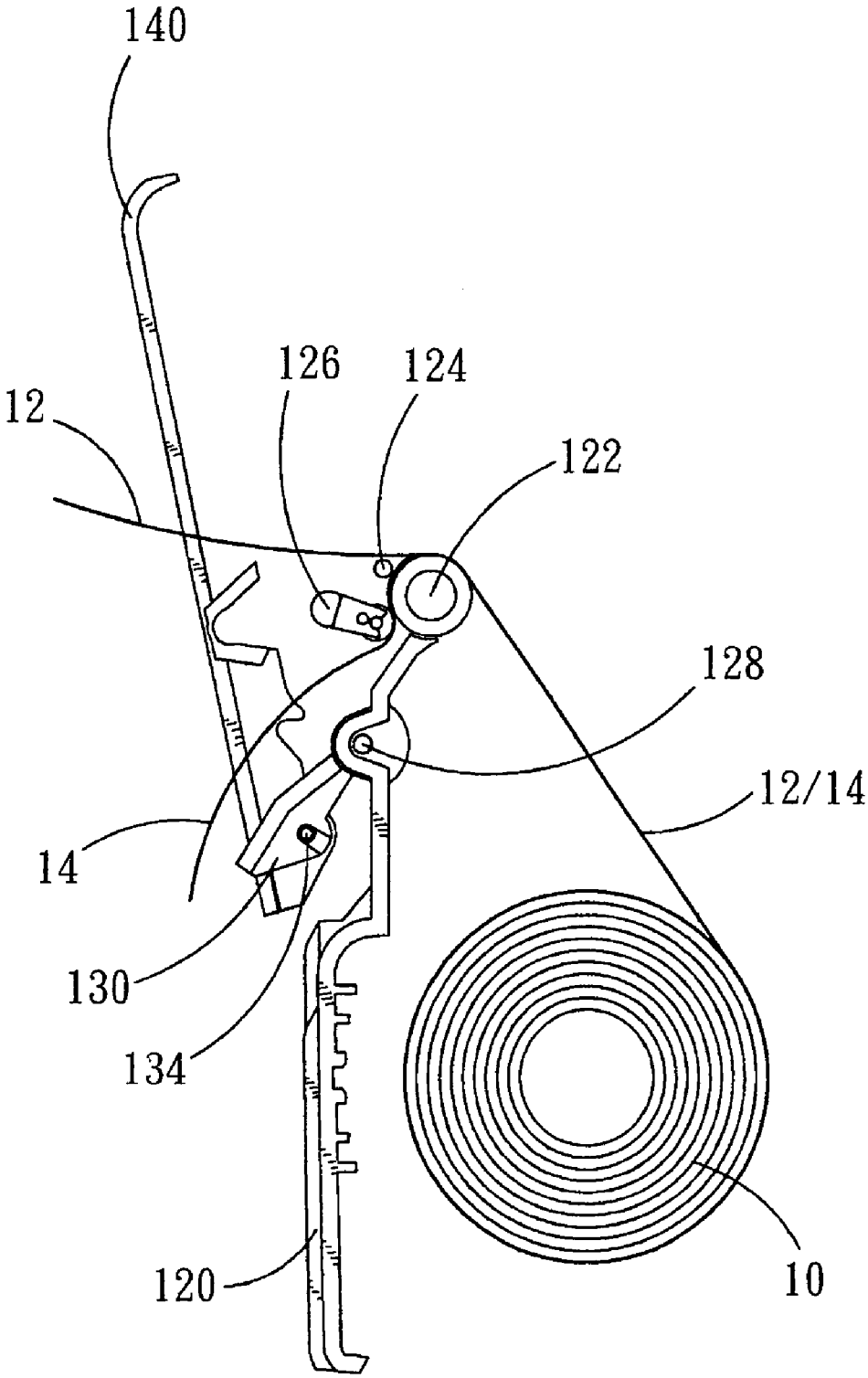
FIG. 3A is a side elevational view of the front cover of the present invention illustrating the condition before a label paper roll is mounted to the printer.
Figure 3B:
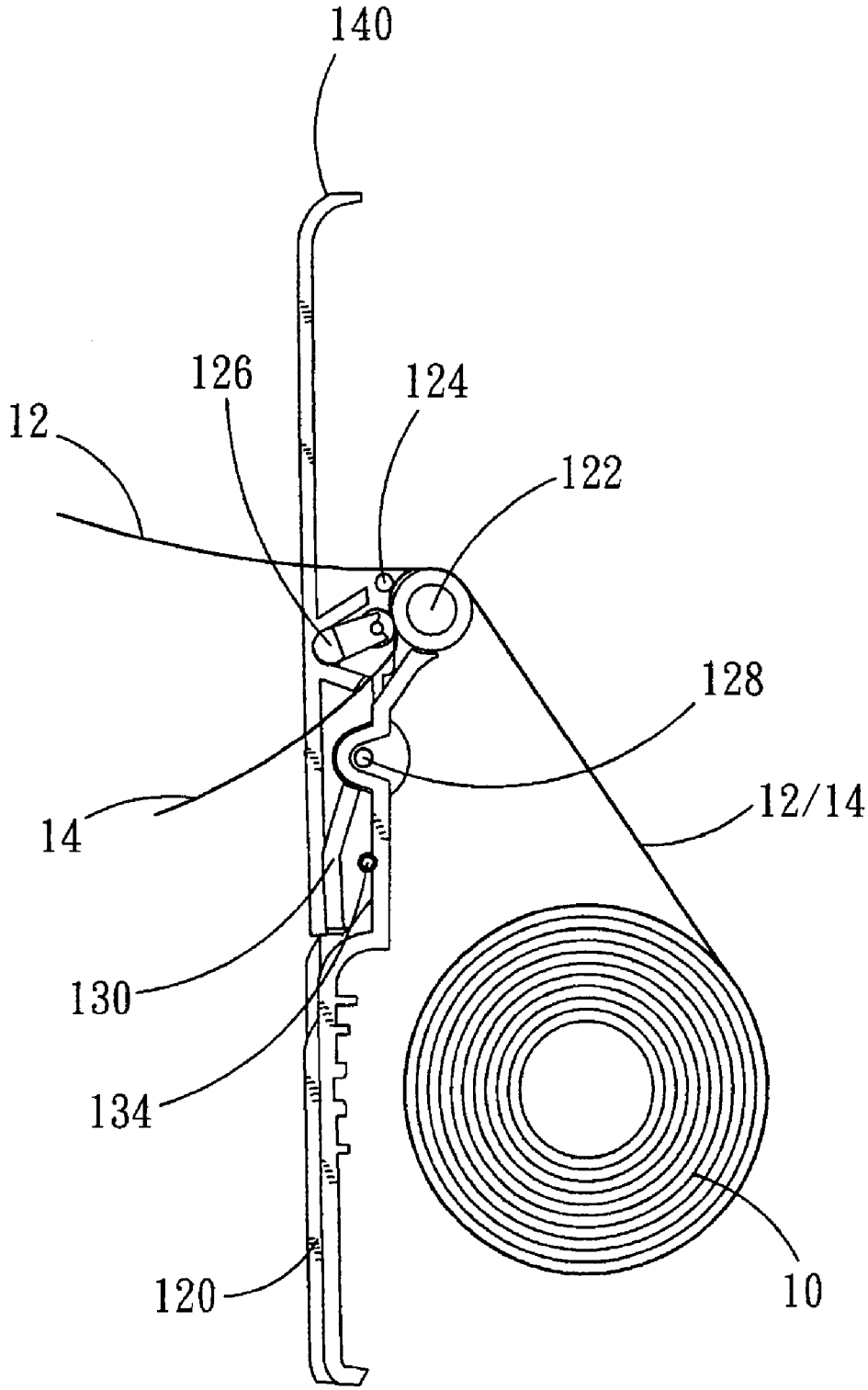
FIG. 3B is a side elevational view of the front cover of the present invention illustrating the condition after the label paper roll is mounted to the printer.

With reference to FIGS. 3A and 3B, which are side elevational views illustrating conditions before and after the label paper roll 10 are mounted in the printer, with certain parts of the printer that do not pertain with the following description eliminated for simplifying the description, the label paper roll 10 comprises a length of label paper that is rolled up and can be unwound. The label paper is composed of a label portion 12 attached to a substrate 14 in a releasable manner. To mount the roll 10 to the printer, a leading end of the length of the label paper is extended around the first cross bar 122 and the label 12 and the substrate 14 are separated from each other by the second cross bar 124. The label 12 is fed forward by passing through upper side of the second cross bar 124, while the substrate 14 moves forward below the second cross bar 124 and extends between the third cross bar 126 and the first cross bar 122. The lock board 140, the pressing board 130, and the front board 120 together form a substantially Z-shape as viewed in the elevational side view. The Z-shape allows the lock board 140 and the pressing board 130 to rotate simultaneously about the second connection bar 134 and the first connection bar 128, respectively, when a user depresses the lock board 140 toward the printer in order to secure the lock board 140 to the printer. When the lock board 140 engages and is thus secured to the printer, the third cross bar 126 is driven by the closing or locking operation of the lock board 140 to tightly interpose between the first cross bar 122 and the third cross bar 126. Further, the front board 120 defines a first discharge opening for feeding out the substrate 14 and the lock board 140 defines a second charge opening for feeding out the label 12.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A front cover structure for a label printer, comprising:

a back board forming a paper roll support device;

a front board coupled to the back board, the front board defining at least one first hole and comprising a first cross bar, a second cross bar, and a third cross bar, the second and third cross bars being parallel to and positioned against the first cross bar;

a pressing board having two side projections in which two second holes defined, the pressing board further defining a third hole, the pressing board being coupled to the front board with a first connection bar extending through the first hole and the second holes; and a lock board defining a plurality of fourth holes in opposite edge portions, the lock board being coupled to the pressing board with a second connection bar extending through the third hole and the fourth holes.

2. The front cover structure as claimed in claim 1, wherein the paper roll support device comprising:

two paper roll brackets formed on a first surface of the back board and opposing each other;

two racks arranged on a second surface of the back board and each being perpendicularly connected to each paper roll bracket through holes defined in the back board;

a pinion arranged on the second surface of the back board and engaging the racks on upper and lower tangents thereof; and two resilient structures respectively arranged between the racks and two fixed points of the back board to apply a center-directed clamping force to the paper roll support device.

3. The front cover structure as claimed in claim 2, wherein the resilient structure comprises a spring.

4. The front cover structure as claimed in claim 1, wherein the front board defines a first discharge opening.

5. The front cover structure as claimed in claim 1, wherein the first cross bar has a fixed shaft.

6. The front cover structure as claimed in claim 1, wherein the second cross bar comprises a label release bar.

7. The front cover structure as claimed in claim 1, wherein the third cross bar has a movable shaft.

8. The front cover structure as claimed in claim 1, wherein the lock board defines a second discharge opening.

9. The front cover structure as claimed in claim 1, wherein the lock board comprises a U-shaped plate having two limbs connected by a bottom, the fourth holes being defined in inner and outer side faces of the limbs.

* * * * *